US007702265B2

(12) United States Patent
Kosugi et al.

(10) Patent No.: US 7,702,265 B2
(45) Date of Patent: Apr. 20, 2010

(54) DEVELOPING UNIT AND IMAGE FORMING APPARATUS

(75) Inventors: Hideki Kosugi, Kanagawa (JP); Yasuyuki Ishii, Tokyo (JP); Takeo Tsukamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 244 days.

(21) Appl. No.: 11/769,363

(22) Filed: Jun. 27, 2007

(65) Prior Publication Data

US 2008/0124138 A1 May 29, 2008

(30) Foreign Application Priority Data

Jun. 27, 2006 (JP) ..... 2006-176106

(51) Int. Cl.
*G03G 15/08* (2006.01)

(52) U.S. Cl. ..... 399/266; 399/265; 399/285

(58) Field of Classification Search ..... 399/265, 399/266, 285, 290, 291
See application file for complete search history.

(56) References Cited

U.S. PATENT DOCUMENTS

| | | | | |
|---|---|---|---|---|
| 5,386,277 | A * | 1/1995 | Hays et al. | 399/291 X |
| 5,701,564 | A * | 12/1997 | Parker | 399/285 |
| 6,816,694 | B2 * | 11/2004 | Adachi et al. | 399/265 |
| 6,895,202 | B2 * | 5/2005 | LeStrange et al. | 399/266 |
| 6,901,231 | B1 * | 5/2005 | Sakai et al. | 399/266 |
| 7,236,720 | B2 | 6/2007 | Nakazato et al. | |
| 7,489,893 | B2 * | 2/2009 | Teraoka et al. | 399/266 |

FOREIGN PATENT DOCUMENTS

| | | |
|---|---|---|
| JP | 03-021967 | 1/1991 |
| JP | 2002-082524 | 3/2002 |
| JP | 2002-258601 | 9/2002 |
| JP | 2002-287484 | 10/2002 |
| JP | 2003-076137 | 3/2003 |
| JP | 2003-263023 | 9/2003 |
| JP | 2004-045943 | 2/2004 |
| JP | 2004-157259 | 6/2004 |
| JP | 2005-173383 | 6/2005 |
| JP | 2005-181711 | 7/2005 |

OTHER PUBLICATIONS

U.S. Appl. No. 12/261,302, filed Oct. 30, 2008, Kosugi, et al.

(Continued)

*Primary Examiner*—Sandra L Brase
(74) *Attorney, Agent, or Firm*—Oblon, Spivak, McClelland, Maier & Neustadt, L.L.P.

(57) ABSTRACT

A developing unit for transferring toner onto a latent image on an image carrier so as to develop the latent image includes a toner carrier, an electric field generator and a separating force applicator. The toner carrier including a plurality of electrodes disposed along the surface thereof and insulated from each other transports the toner to a developing area facing the image carrier. The electric field generator applies a periodic voltage to the plurality of electrodes of the toner carrier so that an electric field is generated on the toner carrier surface to cause the toner charged to a given polarity and borne on the surface of the toner carrier to hop. The separating force applicator applies a separating force to separate the toner on the toner carrier from the surface thereof outside the developing area. The separating force applicator is disposed separately from the electric field generator.

16 Claims, 11 Drawing Sheets

OTHER PUBLICATIONS

U.S. Appl. No. 12/209,812, filed Sep. 12, 2008, Aoki, et al.
U.S. Appl. No. 12/121,122, filed May 15, 2008, Kadota et al.
U.S. Appl. No. 12/140,032, filed Jun. 16, 2008, Ishii, et al.
U.S. Appl. No. 12/170,930, filed Jul. 10, 2008, Takahashi, et al.
U.S. Appl. No. 12/042,892, filed Mar. 5, 2008, Tsukamoto, et al.
U.S. Appl. No. 12/176,054, filed Jul. 18, 2008, Kadota, et al.

* cited by examiner

DEVELOPING UNIT AND IMAGE FORMING APPARATUS

CROSS REFERENCE TO RELATED APPLICATIONS

This patent application is based on and claims priority under 35 U.S.C. §119 from Japanese patent application No. JP 2006-176106 filed on Jun. 27, 2006 in the Japan Patent Office, the entire contents of which are incorporated herein by reference.

BACKGROUND OF THE INVENTION

1. Field of the Invention

Exemplary aspects of the present invention relate to a developing unit and an image forming apparatus, and more particularly to a developing unit for developing a latent image on an image carrier with toner and an image forming apparatus including the same.

2. Description of the Related Art

According to related arts, it is known that a developing unit transports toner to a developing area along with a rotary motion of a toner carrier while an electric field curtain generator provided on the toner carrier generates an electric field curtain which causes toner carried on a surface of the toner carrier to hop.

In such a related art developing unit, a spare charging roller is provided in a manner such that it abuts the toner carrier surface so that the electric field curtain effect stably acts upon the toner carried on the toner carrier surface.

The spare charging roller performs frictional charging on the toner between the spare charging roller and the toner carrier. Thereby, sufficiently charged toner having received the effect of electric field curtain is stably transported to the developing area.

Furthermore, it has been proposed that in a developing apparatus, toner is transferred from a developer carrier to one end surface of a transportation substrate (toner carrier) including a plurality of electrodes. The plurality of electrodes generates an electric field for transporting the toner by causing toner to hop by an electrostatic force. Such a developing apparatus transports the toner, which is transferred from the developer carrier, to the developing area across from a latent image carrier by the electrostatic force while causing the toner to hop on the transportation substrate.

Related art developers cause toner to hop by generating an electric field on a surface of a toner carrier. In order to cause the toner to hop, a weak adherence between the toner carrier surface and the toner may be important. It may also be important to generate an appropriate electric field on the toner carrier surface.

However, in the related art developing apparatuses, there is such a problem that toner may be adsorbed to the toner carrier surface. Consequently, toner may not be able to stably hop in the electric field generated on the toner carrier surface.

The main cause of this problem may be that some kind of external force acts on toner, thereby increasing the adhesion of toner relative to the toner carrier surface beyond the level of an electrostatic force from the electric field.

When the spare charging roller performs the frictional charging on the toner on the toner carrier surface, the toner is pressed against the toner carrier surface causing the adherence of the toner relative to the toner carrier surface to increase. Consequently, there may be such a problem that toner may not be able to stably hop.

Furthermore, when the external force continues to act on the toner carrier surface, the toner may be firmly fixed to the toner carrier surface. In such a case, the adhered toner may disrupt the electric field. Consequently, toner may not be able to stably hop.

When the electric field generated on the toner carrier surface is increased, the adherence of toner to the toner carrier surface may increase, thereby making it possible to cause the toner to hop. However, in such a case, when the toner affected by the increased electric field may be easily separated from the toner carrier surface. Consequently, stable toner hopping may not be able to achieve.

SUMMARY OF THE INVENTION

In view of the foregoing, exemplary embodiments of the present invention provide a developing unit and an image forming apparatus using the same.

The exemplary embodiments provide a developing unit for transferring toner onto a latent image on an image carrier so as to develop the latent image. The developing unit may include a toner carrier, an electric field generator and a separating force applicator.

In exemplary embodiments, the toner carrier may bear and transport the toner to a developing area facing the image carrier, and may include a plurality of electrodes disposed along the surface thereof and insulated from each other.

In exemplary embodiments, the electric field generator may apply a periodic voltage to the plurality of electrodes of the toner carrier so that an electric field is generated on the toner carrier surface to cause the toner charged to a given polarity and borne on the surface of the toner carrier to hop.

In exemplary embodiments, the separating force applicator may apply a separating force to separate the toner borne on the toner carrier from the surface thereof outside the developing area, and the separating force applicator may be disposed separately from the electric field generator.

Exemplary embodiments provide an image forming apparatus.

In exemplary embodiments, the image forming apparatus may include an image carrier, a charging device, an exposure unit, a developing unit described above and a transfer unit.

In exemplary embodiments, the charging device may charge the image carrier. The exposure unit may irradiate the image carrier to form a latent image thereon. The transfer unit may transfer the toner image onto a recording material.

The developing unit may develop the latent image with toner to form a toner image on the image carrier. The developing unit may include the toner carrier, the electric field generator and the separating force applicator described above.

In exemplary embodiments, the image forming apparatus may further includes a plurality of image carrier, and each of the toner images may be overlaid on one another on the recording material.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
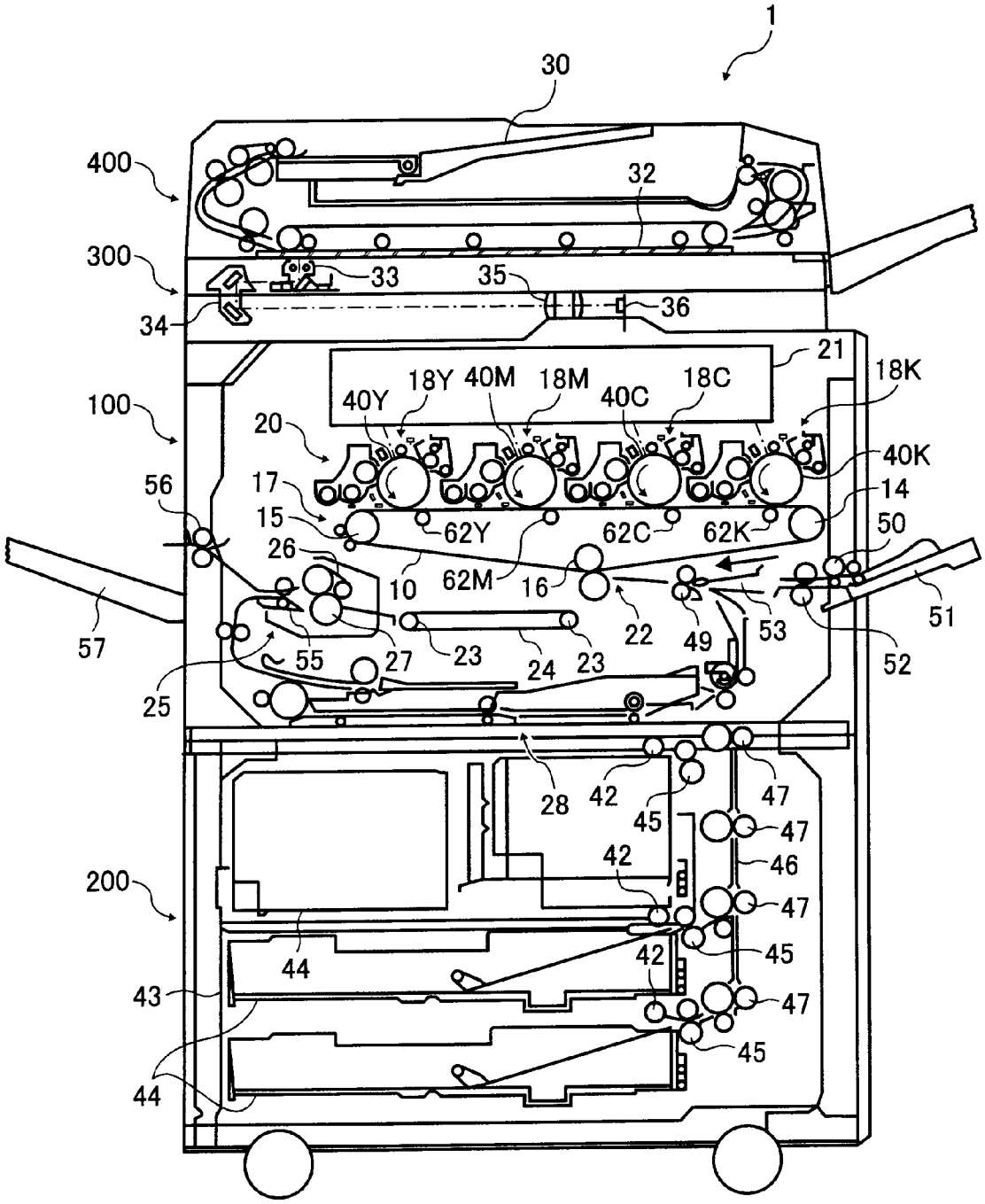
FIG. 1 is a schematic diagram illustrating a copier according to a first exemplary embodiment of the present invention.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Exemplary embodiments of the present invention are now explained below with reference to the accompanying drawings. In the later described comparative example, exemplary embodiment, and alternative example, for the sake of simplicity of drawings and descriptions, the same reference numerals will be given to constituent elements such as parts and materials having the same functions, and the descriptions thereof will be omitted unless otherwise stated.

Typically, but not necessarily, paper is the medium from which is made a sheet on which an image is to be formed. Other printable media is available in sheets and their use here is included. For simplicity, this Detailed Description section refers to paper, sheets thereof, paper feeder, etc. It should be understood, however, that the sheets, etc., are not limited only to paper.

Referring now to the drawings, wherein like reference numerals designate identical or corresponding parts throughout the several views, particularly to FIG. 1, a structure of a copier as an example of an intermediate-transfer type tandem image forming apparatus according to one exemplary embodiment of the present invention is described. However, the image forming apparatus is not limited to the intermediate-transfer type tandem image forming apparatus.

The letter symbols Y, M, C and K hereinafter denote colors of yellow, magenta, cyan, and black, respectively.

FIG. 1 is a schematic diagram illustrating a copier as an image forming apparatus according to a first exemplary embodiment of the present invention. As illustrated in FIG. 1, the copier 1 includes a printing unit 100, a sheet feeder 200 and a scan unit 300 fixedly provided above the printing unit 100. An automatic document feeder (hereinafter referred to as ADF) 400 is mounted to the scan unit 300.

The printing unit 100 includes a tandem-image forming unit 20 in which four photoreceptors 40Y, 40M, 40C and 40K are disposed. There is also provided a control unit (not shown) to control operations of each device in the copier 1.

The scan unit 300 reads image information of a document placed on a contact glass 32 using a sensor 36 and sends the read image information to the control unit. Based on the read image information, the control unit regulates laser beams, LED and the like disposed in an exposure unit 21 of the printing unit 100 so as to irradiate the photoreceptors 40Y, 40M, 40C and 40K serving as latent image carriers with laser beams.

By irradiating the photoreceptors 40Y, 40M, 40C and 40K with laser beams, electrostatic latent images are formed on the surface of the photoreceptors 40Y, 40M, 40C and 40K. Subsequently, the electrostatic latent images are developed as toner images thereon through a predetermined development process.

The sheet feeder 200 includes a paper cabinet 43 in which a plurality of sheet feed cassettes 44 are provided, a sheet conveyance path 46 and so forth. A plurality of conveyance roller pairs 47 are provided at given positions along the sheet conveyance path 46.

Each of the sheet feed cassettes 44 includes sheet feed rollers 42 which sequentially send out a transfer sheet or a recording sheet stored in the sheet feed cassettes 44 from the top. Each of the sheet feed cassettes 44 further includes separating rollers 45 which separate a plurality of transfer sheets from one another in a case where multiple feeding occurs.

The conveyance roller pairs 47 send out the transfer sheet received from the sheet feed cassette 44 to the conveyance roller pair 47 at the rear.

The copier 1 according to the first exemplary embodiment allows manual sheet feeding in addition to automatic document feeding performed by the sheet feeder 200.

On the side of the printing unit 100 there is provided a manual feed tray 51 to enable the manual sheet feeding. The manual feed tray 51 is equipped with a sheet feed roller 50 and a separating roller 52 by which the transfer sheet is transported to the printing unit 100.

The transfer sheet transported from the sheet feeder 200 or the manual feed tray 51 is nipped by a pair of resist rollers 49. The pair of resist rollers 49 sends the nipped transfer sheet to a secondary transfer nip at a given timing.

The secondary transfer nip herein refers to a nip formed by abutting an intermediate transfer belt 10 and a secondary transfer roller 22.

A user may either place a document on a document table 30 of the ADF 400 or a contact glass 32 of the scan unit 300 exposed by an open operation of the ADF 400. Subsequently, the user may press a start button (not shown).

Soon after, the scan unit 300 is driven to read image information of the document transported from the ADF 400 onto the contact glass 32 or the document placed on the contact glass 32 from the beginning.

Specifically, the scan unit 300 initiates a first carriage 33 so as to reflect light emitted from a light source of the scan unit 300, onto the document surface and send the reflected light to a second carriage 34. The second carriage 34 is driven to reflect the reflected light by the mirror of the second carriage 34 to the sensor 36 through an imaging lens 35. Thereby, the image information is read.

When the control unit (not shown) receives the image information from the scan unit 300, a toner image is formed on the photoreceptors 40Y, 40M, 40C and 40K by means of a laser writing process or a development process.

Figure 2:
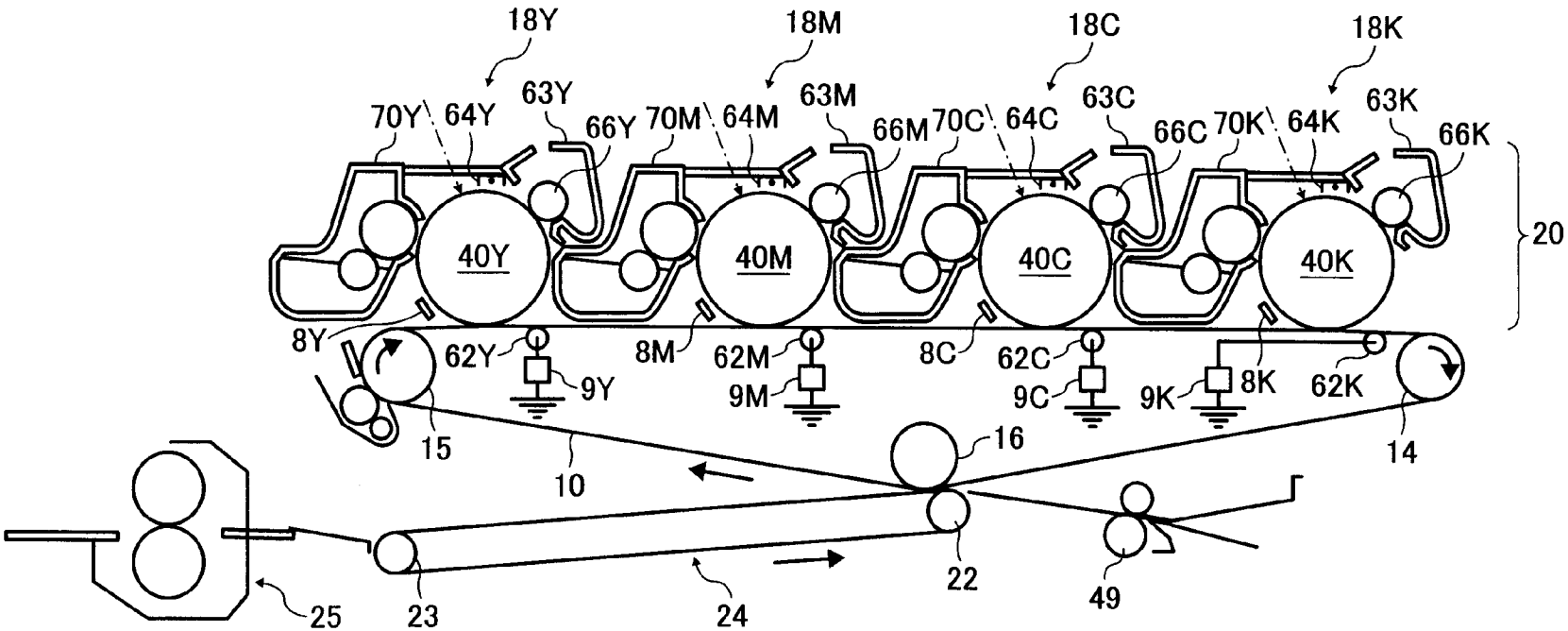
FIG. 2 is an enlarged view of an image forming unit of the copier of FIG. 1.

Referring now to FIG. 2, there is shown an enlarged view of the tandem image forming unit 20 of the print unit 100. The tandem-image forming unit 20 includes four process cartridges 18Y, 18M, 18C and 18K.

The structure of the four process cartridges 18Y, 18M, 18C and 18K is similar to, if not the same as, one another except for the color of toner. Therefore, a detailed description will be given of the process cartridge 18Y as a representative example. The description of the rest of the process cartridges 18M through 18K is omitted herein.

The process cartridge 18Y at least includes the photoreceptor 40Y, a charging device 64Y, a developing unit 70Y, and a cleaning device 63Y, and so forth. These components are integrated together and attachably/detachably mounted to the copier 1.

It should be noted that the process cartridge 18Y may, at least, integrally include the photoreceptor 40Y and the developing unit 70Y.

The photoreceptor 40Y is rotatively driven in a counterclockwise direction by a driving mechanism (not-shown) while the charging device 64Y evenly charges the surface of the photoreceptor 40Y. After charging the photoreceptor surface, the photoreceptor 40Y is irradiated with the laser beam so that an electrostatic latent image is formed thereon.

The electrostatic latent image is developed in the developing area facing a toner carrying roller 71Y as a toner carrier. In such a manner, the toner image in yellow formed on the photoreceptor 40Y is primarily transferred on the later-described intermediate transfer belt 10.

Residual toner remained on the surface of the photoreceptor 40Y after the first transfer process is removed from the photoreceptor 40Y by the cleaning device 63Y. The similar process, if not the same, may be performed in other process cartridges 18M, 18C and 18K.

Accordingly, toner images of respective colors magenta, cyan, and black are formed on the respective colors of photoreceptors 40M, 40C and 40K.

The intermediate transfer belt 10 serving as an intermediate transfer mechanism which is an image carrier is spanned between three spanning rollers 14, 15 and 16. One of the spanning rollers is rotatively driven by the driving mechanism (not shown) so that the intermediate transfer belt 10 may continuously move in a clockwise direction as shown by an arrow in FIG. 2.

First transfer rollers 62Y, 62M, 62C and 62K are disposed aslant toward the downstream side in a surface moving direction of the intermediate transfer belt 10 or diagonally across the photoreceptors 40Y, 40M, 40C and 40K, respectively.

A primary transfer bias voltage is applied to the first transfer rollers 62Y, 62M, 62C and 62K by power supplies 9Y, 9M, 9C and 9K, respectively, so that a first transfer electric field is formed.

Toner images of different colors Y, M, C, and K formed on the respective photoreceptors 40Y, 40M, 40C and 40K are primarily transferred on the intermediate transfer belt 10 in response to the effect of the first transfer electric field and the primary transfer nip pressure.

Each of the toner images is sequentially transferred and overlaid on one another on the intermediate transfer belt 10. Accordingly, a four-color toner image is formed on the intermediate transfer belt 10.

In a second transfer area, there are provided a sheet conveyance belt 24 and two spanning rollers 22 and 23. When the spanning roller 23 is rotatively driven by a driving mechanism (not shown), the sheet conveyance belt 24 continuously moves in a counterclockwise direction shown by an arrow in FIG. 2.

The other spanning roller, that is, the spanning roller 22 presses the sheet conveyance belt 24 against the intermediate transfer belt 10 wound around the spanning roller 16. Thereby, a second transfer nip is formed in a space between the intermediate transfer belt 10 and the sheet conveyance belt 24.

The resist roller pair 49 sends out a transfer sheet to the second transfer nip at a time the four-color toner image on the intermediate transfer belt 10 advances to the second transfer nip.

In the second transfer nip, the four-color toner image on the intermediate transfer belt 10 is secondarily transferred on the transfer sheet in response to the effect of the second transfer electric field and the second transfer nip.

Accordingly, a full-color image is formed when the four-color toner image is secondarily transferred on the transfer sheet.

The transfer sheet on which the full-color image is formed in an above-described manner is transported to a fixing device 25 along with a movement of the sheet conveyance belt 24. The transfer sheet is nipped by a heating roller and a pressure roller. Accordingly, the full-color image is fixed on the surface of the transfer sheet.

Subsequently, the transfer sheet after being fixed is ejected to a catch tray 57 through a discharging roller pair 56.

Next, a description will be given of a structure and operation of the developing units 70Y, 70M, 70C and 70K. The structure of the developing units 70Y, 70M, 70C and 70K is similar to, if not the same as, one another, except for toner colors. Therefore, letter symbols Y, M, C and K denoting colors of yellow, magenta, cyan, and black are omitted herein.

Figure 3:
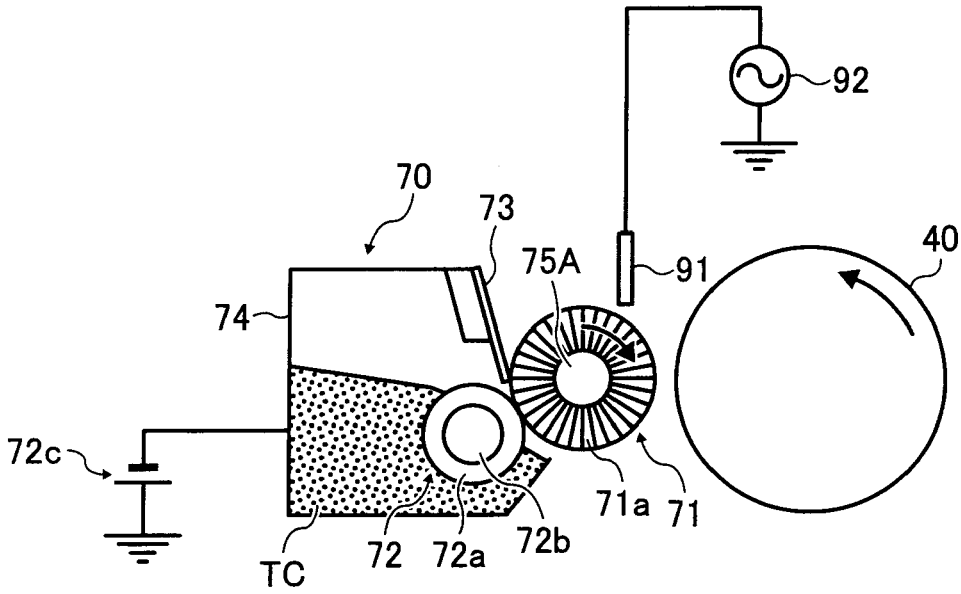
FIG. 3 is a schematic diagram illustrating a section of a developing unit of the copier.

FIG. 3 is a schematic diagram illustrating the developing unit 70 according to the first exemplary embodiment. The developing unit 70 includes the toner carrying roller 71, a toner supply roller 72, a doctor blade 73, a developer casing 74.

The toner carrying roller 71 serves as a toner carrier for transporting toner to the developing area across from the photoreceptor 40. The toner supply roller 72 serving as a toner supply member supplies toner to the toner carrying roller 71.

The doctor blade 73 serves as a layer thickness regulator which regulates a thickness of the toner layer supplied on the toner carrying roller 71 before toner is transported to the developing area.

The developer casing 74 stores a two-component developer TC (hereinafter referred to as developer) consisting of toner (T) and carriers (C).

In the first exemplary embodiment, the developer containing the magnetic carriers with a particle diameter of 55 μm and polyester toner with a particle diameter of 7 μm may be used. The weight ratio (wt %) of the magnetic carriers and the polyester toner may be between 5% and 7%.

A stationary magnet 72*b* and a rotary sleeve 72*a* constitute the toner supply roller 72. The stationary magnet 72*b* is fixedly disposed inside the toner supply roller 72 and serves as a magnetic field generator. The rotary sleeve 72*a* rotates around the stationary magnet 72*b*.

The toner carrying roller 71 is rotatively driven in a clockwise direction in FIG. 3. The rotary sleeve 72*a* of the toner supply roller 72 is rotatively driven in a clockwise direction.

The toner supply roller 72 carries the magnetic carriers of the developer TC in the developer casing on the surface thereof by means of the magnetic force. Thereby, toner which electrostatically adheres to the magnetic carriers is also carried on the surface of the toner supply roller 72.

In such a manner, the developer TC carried on the surface of the toner supply roller 72 may be transported to an opposing region opposite to the toner carrying roller 71 as the rotary sleeve 72*a* rotates.

In the opposing region, the developer TC may come into contact with the surface of the toner carrying roller 71. Accordingly, the toner in the developer may mechanically travel to the surface of the toner carrying roller 71.

Furthermore, according to the first exemplary embodiment, a DC power supply 72*c* may be connected to the rotary sleeve 72*a* of the toner supply roller 72 so as to form an electric field which exerts an electrostatic force on toner on the toner supply roller 72 so that the toner travels to the toner carrying roller 71. Thereby, the toner electrostatically travels to the surface of the toner carrying roller 71.

The toner supplied to the toner carrying roller 71 is transported in the clockwise direction in FIG. 3 along with a rotary movement of the toner carrying roller 71. The doctor blade 73 may be disposed such that a relatively small gap so-called a doctor gap may be formed in a space between the surface of the toner carrying roller 71 and the doctor blade 73.

The toner carried on the surface of the toner carrying roller 71 passes the doctor gap so that the thickness of toner may be regulated at a certain thickness. In such a manner, the toner layer of which thickness is regulated may be transported to the developing area along with the rotary movement of the toner carrying roller 71.

As will be discussed later, a developing electric field may be formed in the developing area. The developing electric field may cause the toner on the toner carrying roller 71 to travel to the electrostatic latent image on the photoreceptor 40. Thereby, the development process may be performed.

Figure 4:
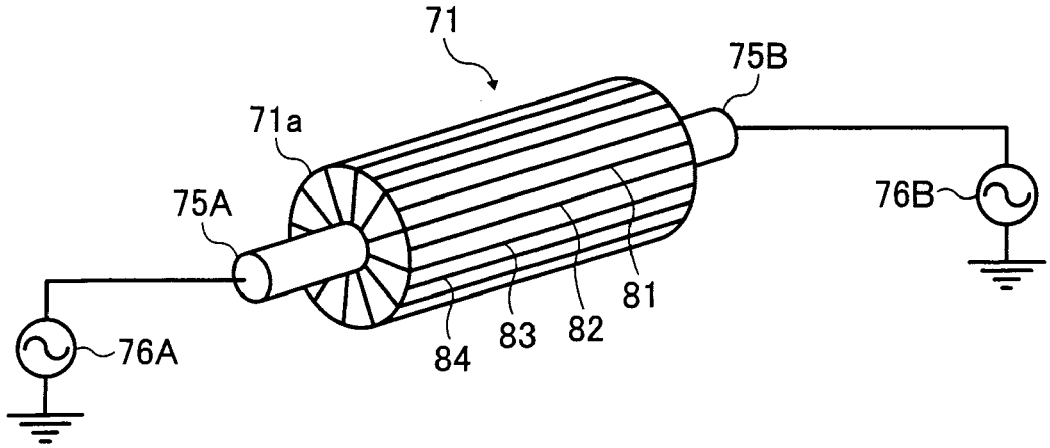
FIG. 4 is a perspective view illustrating a toner carrying roller of the developing unit of FIG. 3.

Referring now to FIG. 4, a perspective view of the toner carrying roller 71 is illustrated. The toner carrying roller 71 is of a roller type and is rotatively driven so that the surface thereof moves along with the rotary movement.

A number of electrodes, for example, electrodes 81, 82, 83, 84 and so forth may be provided along the circumferential surface of the toner carrying roller 71.

These electrodes may constitute an electrode pattern, and may be arranged at a certain pitch p[μm] in a surface moving direction. The electrodes 81, 82, 83, 84 and so forth may be insulated from each other.

In the first exemplary embodiment, a group of electrodes having an odd number such as the electrode 81 and the electrode 83 constitutes an odd-number electrode group in the electrode pattern.

A first voltage input terminal to input a voltage to the odd-number electrode group may be provided to one end of the roller shaft of the toner carrying roller 71, that is, a roller shaft 75A on the front side in FIG. 4.

Furthermore, a group of electrodes having an even number such as the electrode 82 and the electrode 84 constitutes an even-number electrode group in the electrode pattern.

A second voltage input terminal to input a voltage to the even-number electrode group is provided to the other roller shaft end of the toner carrying roller 71, that is, a roller shaft 75B at the rear in FIG. 4.

Each of alternating-current (AC) power supplies 76A and 76B may apply an AC voltage which is a periodic voltage to an end portion of the roller shafts 75A and 75B using an electrode brush or the like, respectively.

More specifically, an AC voltage, which causes a direction of an electric field or a hopping electric field formed between each of the electrodes such as the electrodes 81 and 83 of the odd-number electrode group, and the electrodes such as the electrodes 82 and 84 of the even-number electrode group to periodically invert, may be applied to each end of the roller shafts 75A and 75B.

Accordingly, the periodic inversion of the hopping electric field may act on the toner (T) carried on the surface of the toner carrying roller 71.

Thereby, the toner may travel or hop back and forth between the electrodes such as the electrodes 81 and 83 of the odd-number electrode group, and the electrodes such as the electrodes 82 and 84 of the even-number electrode group. Such a movement may be so-called a flare.

A method in which the toner in the flare state is transported to the developing area for development may be called a flare developing method.

The adhesion of the surface of the toner carrying roller 71 and the toner in the flare state may be relatively small. Thereby, it is possible to achieve an effective development.

In the first exemplary embodiment, the AC voltage is applied between each of the electrodes such as the electrodes 81 and 83 of the odd-number electrode group, and the electrodes such as the electrodes 82 and 84 of the even-number electrode group so that the direction of the electric field formed between the adjoining electrodes periodically inverts. Accordingly, the hopping electric field is formed.

However, in so far as the hopping electric field to cause the toner carried on the surface of the toner carrying roller to hop is generated on the surface of the toner carrying roller, any periodic voltages may be applied to the electrodes provided to the circumferential surface of the toner carrying roller.

Therefore, the direction of the electric field between the adjoining electrodes does not have to periodically invert.

Instead, it may be structured such that the direction of the electric field between every other electrode periodically inverts, or the structure may not be limited to the structures described above.

Next, with reference to FIGS. 5A and 5B, a description will be given of one example of a manufacturing method of the toner carrying roller 71.

Figure 5A:
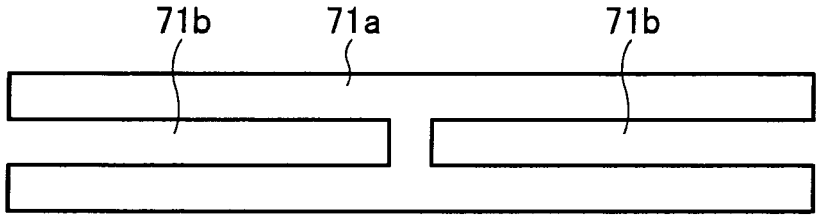
FIGS. 5A and 5B are a diagram for explaining a manufacturing method of the toner carrying roller of FIG. 4.

As illustrated in FIG. 5A, shaft holes 71*b* may be provided in a cylindrical tube 71*a* of acrylic resin which serves as an insulator.

Figure 5B:
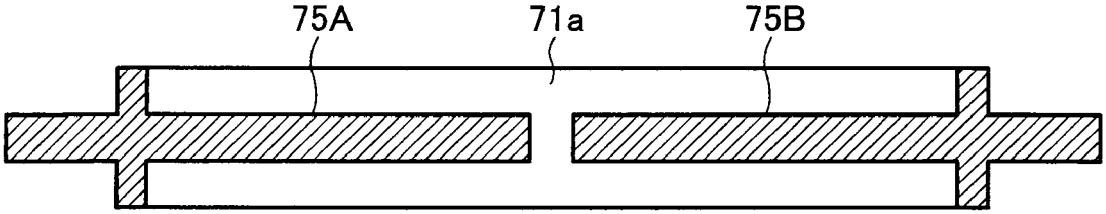

As illustrated in FIG. 5B, when manufacturing the toner carrying roller 71, electrode members made of stainless steel, that is, the roller shafts 75A and 75B may be pressed into the shaft holes 71*b* provided in the cylindrical tube 71*a*.

As will be later described, the shaft rollers 75A and 75B are each connected to the electrodes 81 and 83 of the odd-number electrode group, and the electrodes such as the electrodes 82 and 84 of the even-number electrode group, respectively.

Referring now to FIGS. 6A through 6E, a description will be given of a process of forming an electrode pattern on the toner carrying roller 71.

FIGS. 6A through 6E are cross-sectional views taken along the rotary shaft of the toner carrying roller 71.

Figure 6A:
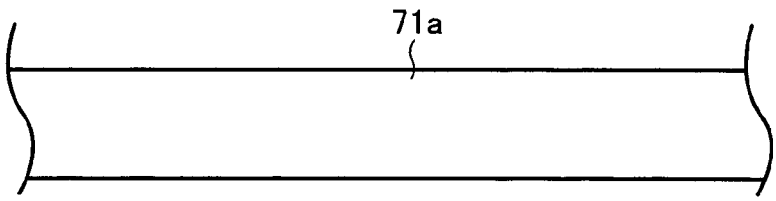
FIGS. 6A through 6E are cross-sectional views of the toner carrying roller.

As shown in FIG. 6A, prior to forming the electrode pattern shown FIG. 5B, a smooth surface may be obtained by peripheral turning of the surface of the toner carrying roller 71.

Figure 6B:
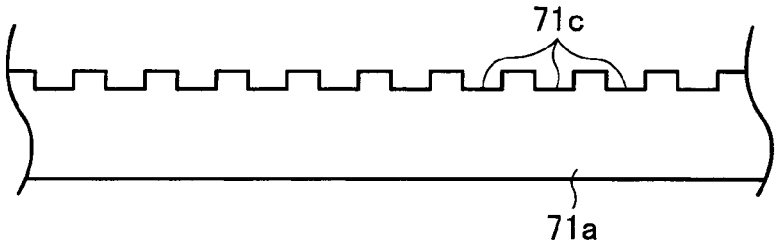

Next, as shown in FIG. 6B, grooves 71*c* with a groove pitch of 100 μm and a groove width of 50 μm may be formed by means of a cutting operation.

Figure 6C:
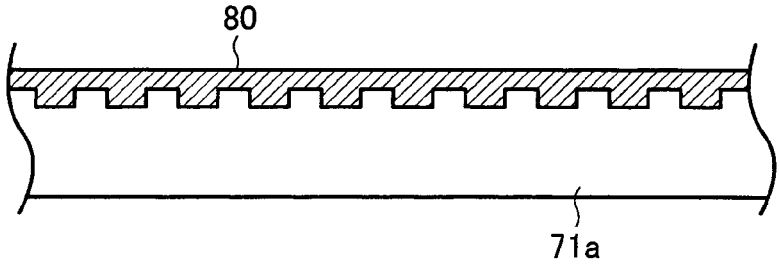

Subsequently, as shown in FIG. 6C, the cylindrical tube 71*a* on which grooves are formed may be plated with an electroless nickel 80.

Figure 6D:
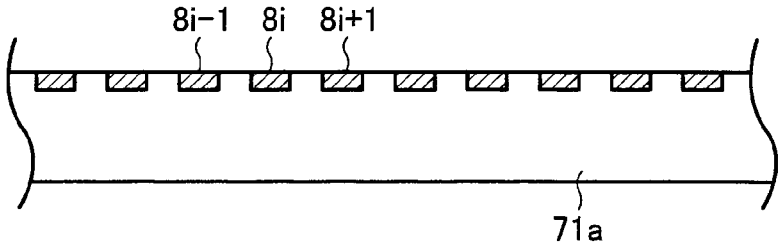
Figure 6E:
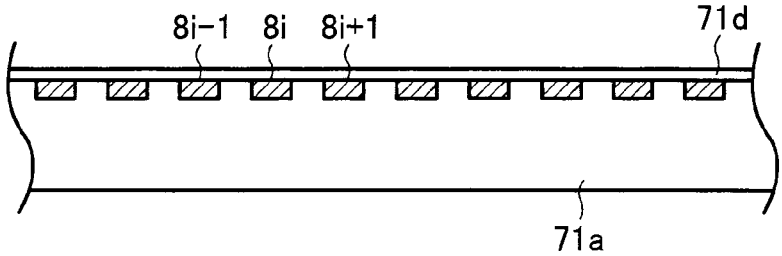

Next, as shown in FIG. 6D, the peripheral surface of the roller 71 plated with the electroless nickel 80 may be turned so as to remove an excess conductor film. At this time, the electrodes 81 through 84 and so forth may be formed in the grooves 71C being insulated from each other.

Subsequently, the cylindrical tube 71*a* may be coated with a silicon-type resin so that the roller surface may be smoothened.

In the meantime, a surface protective layer 71*d* with a thickness of approximately 5 μm and a volume resistivity of approximately $10^{10}$ Ω·cm is formed on the cylindrical tube 71*a*.

It may be preferred that the volume resistivity of the surface protective layer 71*d* be within a range between $10^{9}$ Ω·cm and $10^{12}$ Ω·cm.

Figure 7:
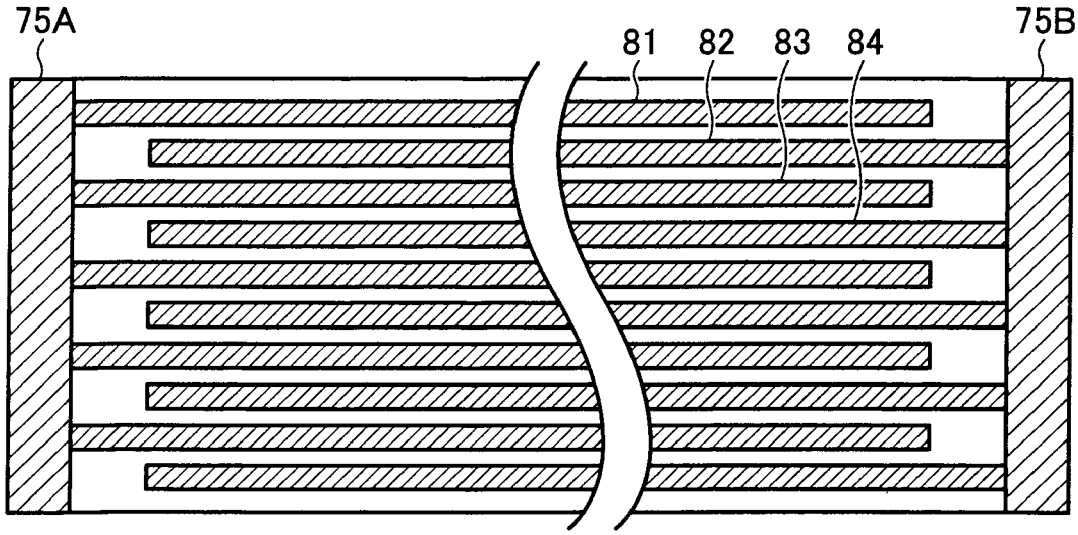
FIG. 7 is a schematic diagram illustrating an electrode pattern of the toner carrying roller.

In a manner described above, the electrode pattern as shown in FIG. 7 may be formed along the surface of the toner carrying roller 71.

The maximum potential difference between each of the electrodes such as the electrodes 81 and 83 of the odd-number electrode group, and the electrodes such as the electrodes 82 and 84 of the even-number electrode group is Vmax[V]. The electrode pitch is p[μm].

When the product of Vmax [V] divided by p[μm] is greater than 1 (Vmax[V]/p[μm]>1), the flare may start to get activated. When the product of Vmax[V] divided by p[μm] is greater than 3 (Vmax[V]/p[μm]>3), the flare may be fully activated.

The material for the surface protective layer 71*d* may preferably be a material which may positively charge the toner T through friction with the toner T. The material may preferably be of a glass-type or a carrier coat material for the developer. Furthermore, it may be preferred that the electrode pitch p be smaller than the development gap d, that is, p<d.

In the developing unit 70 using the toner carrier roller 71, the effect of the hopping electric field generated by the AC voltage applied to each of the electrodes 81 through 84 and so forth may cause the toner T supplied to the toner carrying roller 71 to turn to the flare state.

When the toner carrying roller 71 is rotatively driven, the surface thereof may move accordingly so that the toner may be transported to the developing area opposite to the photoreceptor 40.

The toner which has not been used in the development process in the developing area and remains on the surface of the toner carrying roller 71 returns again to an opposite position relative to the toner supply roller 72 along with a rotary movement of the toner carrying roller 71.

At this time, toner on the toner carrying roller 71 may be in the flare state. Thus, the adhesion of the toner relative to the toner carrying roller 71 may be relatively small.

Consequently, the toner residue on the surface of the toner carrying roller 71 may easily be scraped or may be smoothened by the developer carried on the toner supply roller 72.

In the first exemplary embodiment, a non-image portion of the surface of the photoreceptor 40 which is evenly charged by the charging device 64 is exposed so that the potential is reduced.

The potential difference between the potential of the image portion which is not exposed and an average potential of the toner carrying roller 71 generates the developing electric field by which toner is adhered to the image portion of the photoreceptor 40.

In the first exemplary embodiment, the AC voltage applied to each of the electrodes such as the electrodes 81 and 83 of the odd-number electrode group, and the AC voltage applied to the electrodes such as the electrodes 82 and 84 of the even-number electrode group are of an AC voltage with the same amplitude (Vpp=200V) and the same frequency (1 k[Hz]).

Each phase is different by 180 degree. The average potential of the toner carrying roller 71 is zero.

Needless to say, the toner may be adhered to the image portion of the photoreceptor 40 through a following process.

The image portion of the surface of the photoreceptor 40 which is evenly charged by the charging device 64 may be exposed so that the potential may be reduced.

Thereby, the potential difference between the potential of the image portion and the average potential of the toner carrying roller 71 generates a developing electric field. Accordingly, the toner may be adhered to the image portion of the photoreceptor 40.

When some kind of an external force causes the toner on the surface of the toner carrying roller 71 to increase the adhesion with the surface of the toner carrying roller 71, the toner which may not be able to turn to the flare state by the hopping electric field by the electrodes 81 through 84 and so forth may be generated.

Such toner may remain on the surface of the toner carrying roller 71 without contributing to the development process even though the toner is transported to the developing area. When such toner increases, the efficiency of the development may decrease.

Furthermore, the developer on the toner supply roller 72 may not be able to separate the toner from the surface of the toner carrying roller 71. Consequently, the toner may remain on the surface of the toner carrying roller 71 for an extended period of time, causing the toner to firmly adhere to the surface.

In such a case, an appropriate hopping electric field may not be formed around an area where the toner is firmly adhered. Consequently, it may be difficult to turn toner transported to the area in the vicinity of the area where the toner is firmly adhered to the flare state. Thus, the efficiency of the development may further decrease in the area.

In light of the above, according to the first exemplary embodiment, there is provided a separating electric field generator serving as a separating force applicator which generates a separating force for separating the toner carried on the surface of the toner carrying roller 71 from the surface thereof using an electrostatic force or a separating force.

As shown in FIG. 3, the separating electric field generator includes an electrode plate 91 and an AC power supply 92. The electrode plate 91 is disposed facing the surface of the toner carrying roller 71 near the upstream side of the developing area in the surface moving direction or in the toner conveyance direction of the toner carrying roller 71. The AC power supply 92 applies an AC voltage to the electrode plate 91.

When the AC power supply 92 applies the AC voltage to the electrode plate 91, a vibration electric field is formed in a space between the electrode plate 91 and the toner carrying roller 71.

According to the first exemplary embodiment, when the developer on the toner supply roller 72 rubs against the toner on the toner carrying roller 71, and the toner passes through the doctor gap, an external force which presses the toner carried on the toner carrying roller 71 against the surface of the toner carrying roller 71 may be applied to the toner on the toner carrying roller 71.

Due to such an external force, there may be a case in which the adhesion of the toner relative to the surface of the toner carrying roller 71 may increase.

In the first exemplary embodiment, even if the adhesion of the toner relative to the surface of the toner carrying roller 71 increases, when passing the opposing region of the electrode plate 91, the vibration electric field may cause the toner on the surface of the toner carrying roller 71 to reduce the adhesion relative to surface of the toner carrying roller 71.

As a result, the hopping electric field by the electrodes 81 through 84 and so forth may cause the toner to turn to the flare state.

As described above, in the first exemplary embodiment, the separating force or the electrostatic force for causing the vibration electric field to separate the toner carried on the surface of the toner carrying roller 71 from the surface thereof may be applied to the toner carried on the surface of the toner carrying roller 71 in the vicinity of the developing area at the upstream of the surface moving direction of the toner carrying roller 71.

The separating force may be applied to a further downstream of the surface moving direction of the toner carrying roller than the place where an external force against the toner carrying roller surface may be applied to the toner on the toner carrying roller 71.

However, the separating force may be applied to the further upstream than the developing area in the surface moving direction of the toner carrying roller.

Thereby, the toner in the flare state due to the separating force may be transported to the developing area before the external force again causes the toner to firmly adhere to the toner carrying roller surface and to become a static state. Because the toner in the stable flare state is transported to the developing area, the efficiency of the development may be enhanced.

Next, a description will be given of another exemplary embodiment (hereinafter referred to as a second exemplary embodiment) of the present invention which may be applied to a copier as an image forming apparatus.

Figure 8:
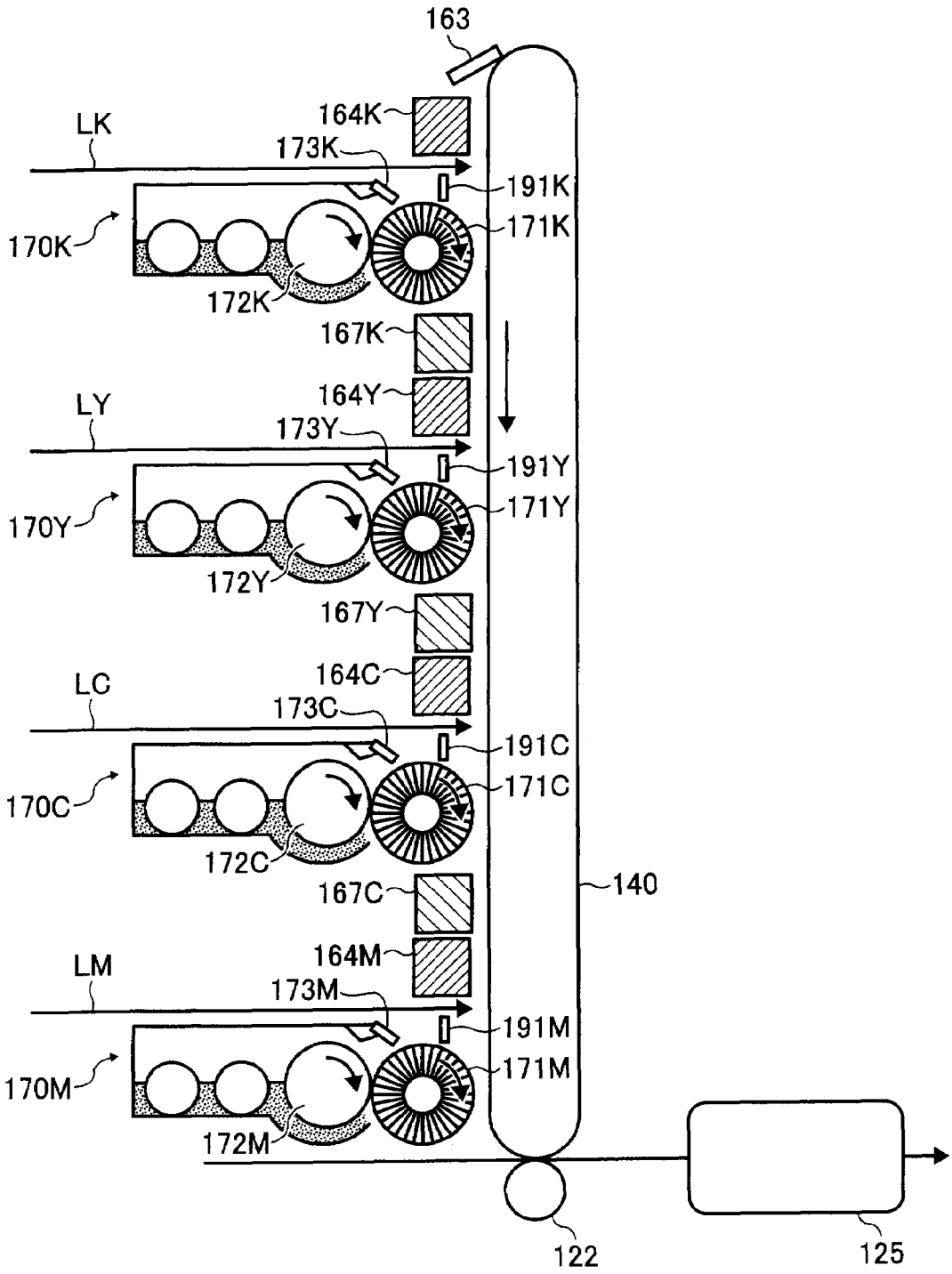
FIG. 8 is a schematic diagram illustrating a section of development units of a copier according to a second exemplary embodiment.

Referring now to FIG. 8, there is shown an enlarged view of a printing unit of a copier according to the second exemplary embodiment.

The copier of the second exemplary embodiment includes developing units 170K, 170Y, 170C and 170M having a similar, if not the same, structure as the developing units 70 of the first exemplary embodiment described above. Toner images of different colors are overlapped on one another on a belt-type photoreceptor 140 serving as a latent image carrying mechanism.

The photoreceptor 140 is spanned between two rollers (not shown) and is rotatively driven in an arrow direction in FIG. 8. The developing units 170K, 170Y, 170C and 170M for forming images of black, yellow, cyan and magenta on the surface of the photoreceptor 140 are arranged on the left side of the photoreceptor 140 in FIG. 8, respectively.

Except for the printing unit, the copier has the same, if not the same, structure as that of the copier of the exemplary embodiment described above.

When forming a color image, a charging device 164K evenly charges the surface of the photoreceptor 140. An exposure apparatus (not shown) serving as a latent image forming mechanism exposes the surface of the charged photoreceptor 140 with a light beam LK modulated by an image data of black.

Thereby, an electrostatic latent image in black (K) is formed on the surface of the photoreceptor 140.

Subsequently, the electrostatic latent image in black is developed by the toner in the flare state carried on the surface of a toner carrying roller 171K so that a toner image in black is formed.

In other words, after a doctor blade 173K regulates the thickness of the toner layer on the surface of the toner carrying roller 171K supplied from the developer on the toner supply roller 172K, the vibration electric field by an electrode plate 191K causes the toner to turn to the flare state.

Subsequently, the toner in the flare state is transported to the developing area, and the electrostatic latent image on the photoreceptor 140 is developed with the toner.

Subsequently, the surface of the photoreceptor 140 is discharged by a discharging device 167K.

In such a manner, when the toner image in black is formed on the surface of the photoreceptor 140, a charging device 164Y evenly charges the surface thereof. Subsequently, similar to the image forming processing of the image in black, the exposure unit (not shown) exposes the charged surface of the photoreceptor 140 with a light beam LY modulated by the image data of yellow.

The electrostatic latent image formed in yellow is developed with the toner in the flare state carried on a toner carrying roller 171Y of a developing unit 170Y, and becomes a toner image in yellow. Subsequently, a discharging device 167Y discharges the surface of the photoreceptor 140.

Subsequently, similar to the image forming processing of the image in black and yellow, image forming processing for cyan and magenta is performed so that the toner images of each color are overlaid on one another on the surface of the photoreceptor 140 forming a full-color image.

A sheet feeder (not shown) feeds a transfer sheet. A transfer bias is applied to a transfer roller 122 serving as a transfer mechanism by a power source. The full-color image on the photoreceptor 140 is transferred by the transfer roller 122.

The full-color image transferred on the transfer sheet is fixed by a fixing device 125. Then, the transfer sheet is ejected out. After the full-color image is transferred, residues including residual toner remained on the surface of the photoreceptor 140 is removed from the photoreceptor 140 by a cleaning device 163 as a cleaning mechanism.

In the second exemplary embodiment described above, toner images in four colors are formed on one photoreceptor 140 and are transferred at once on a transfer sheet. In such an image forming processing, the color misalignment is less when compared with the tandem-type image forming apparatus using an intermediate transfer method. Therefore, it is possible to achieve a high-quality full-color image.

Next, a description will be given of one exemplary variation of the first exemplary embodiment. The developing unit of the first exemplary variation may be applied to the copier of the second exemplary embodiment.

Figure 9:
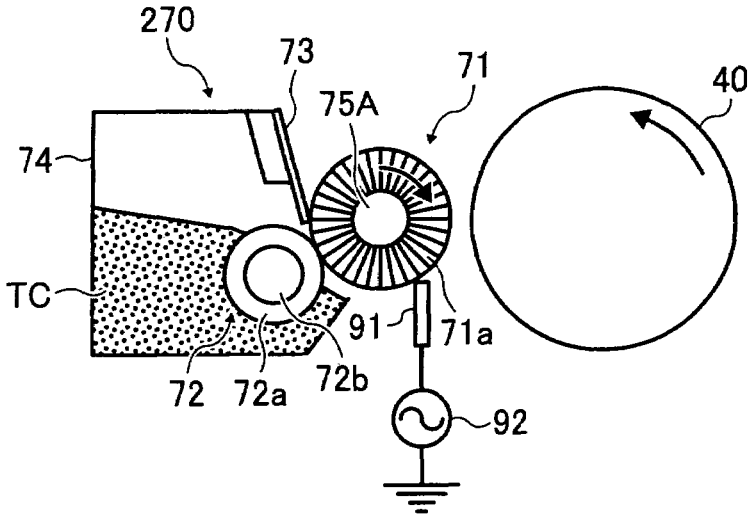
FIG. 9 is a schematic diagram illustrating a development unit according to a first exemplary variation.

Referring now to FIG. 9, there is shown a schematic diagram illustrating a developing unit 270 according to the first exemplary variation.

As described above, when toner which remains on the surface of the toner carrying roller 71 without contributing to the development process passes the developing area, the toner may still remain on the surface of the toner carrying roller 71. Consequently, the toner does not turn to the flare state.

A significant amount of such toner may be rubbed off by the developer on the toner supply roller 72 and may be recovered in the developing unit 270. However, the toner having high adhesion with the surface of the toner carrying roller may not be recovered only by the developer rubbing off the toner.

The toner may remain on the surface of the toner carrying roller 71 for an extended period of time, and may firmly adhere to the toner carrying roller 71.

When such strong adhesion occurs, it may be difficult to form an appropriate hopping electric field around the area where the strong adhesion occurred. Consequently, it may be difficult to turn the toner transported to the area in the vicinity of the area where the strong adhesion occurred to the flare state. As a result, the efficiency of development in the subsequent development process may decrease around the area where the strong adhesion occurred.

In light of the above, in the first exemplary variation, the electrode plate 91 is disposed facing the surface of the toner carrying roller 71 near the downstream side of the developing area in the surface moving direction or in the toner conveyance direction of the toner carrying roller 71.

Thereby, the separating force or the electrostatic force for causing the vibration electric field to separate the toner carried on the surface of the toner carrying roller 71 from the surface thereof may be applied to the toner carried on the surface of the toner carrying roller 71 near the upstream side of the developing area in the surface moving direction of the toner carrying roller 71.

Accordingly, the toner which remains on the surface of the toner carrying roller 71 without contributing to the development process and passed through the developing area may be turned to the flare state and be transported to the opposing region relative to the toner supply roller 72.

The toner in the stable flare state may be transported to the opposing region relative to the toner supply roller 72.

Therefore, the toner recovery efficiency by the developer rubbing off the toner may be enhanced. As a result, it is possible to suppress a state in which the toner is firmly adhered to the surface of the toner carrying roller 71 and reduction of the development efficiency.

Next, a description will be given of another exemplary variation (hereinafter referred to as a second exemplary variation) of the first exemplary embodiment.

The second exemplary variation of the developing unit may be applied to the copier of the second exemplary embodiment.

Figure 10:
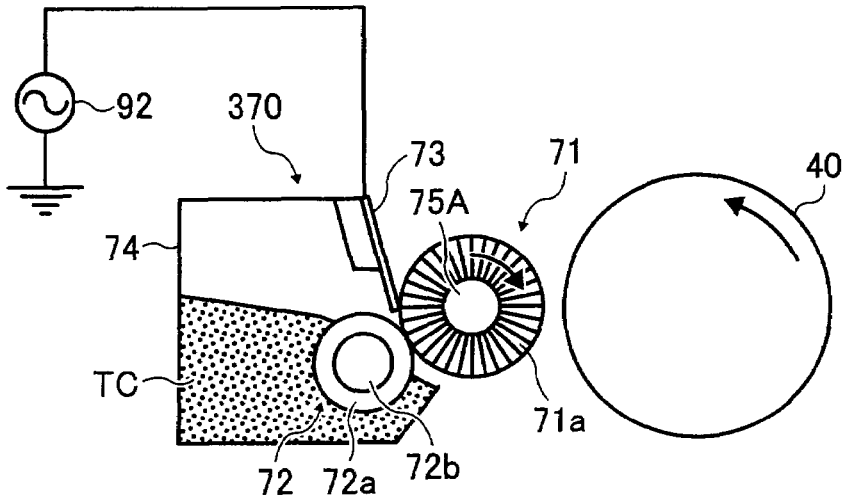
FIG. 10 is a schematic diagram illustrating a development unit according to a second exemplary variation.

Referring now to FIG. 10, there is shown a schematic diagram illustrating a developing unit 370 of the second exemplary variation.

In the second exemplary variation, no electrode plate 91 is provided. The AC power source 92 may be connected to the doctor blade 73 so as to form the vibration electric field in the doctor gap without the electrode plate 91. Thereby, the toner adhesion relative to the surface of the toner carrying roller 71 may be reduced.

As a result, the thickness of the toner layer may be regulated when the toner carried on the surface of the toner carrying roller 71 passes through the doctor gap. In the meantime, the toner adhesion against the toner carrying roller surface may be reduced.

In such a manner, as shown in the second exemplary variation, when an AC voltage is applied to a given part disposed facing the surface of the toner carrying roller 71, the separating force or the electrostatic force for parting the toner from the toner carrying roller surface may be applied to the toner.

Consequently, the toner adhesion relative to the surface of the toner carrying roller 71 may be reduced without increasing the number of parts. Thereby, the amount of toner in the flare state may be increased.

As shown in the second exemplary variation, when the AC voltage is applied to the doctor blade 73, the toner which has turned to the flare state in the doctor gap due to the separating force may be transported to the developing area before an external force causes the toner to firmly adhere to the toner carrying roller surface and to become a static state.

Therefore, similar to the first exemplary embodiment, the toner in the stable flare state may be transported to the developing area. Thereby, it is possible to enhance the development efficiency.

Next, a description will be given of another exemplary variation (hereinafter referred to as a third exemplary variation) of the first exemplary embodiment. The third exemplary variation of the developing unit may be applied to the copier of the second exemplary embodiment.

Figure 11:
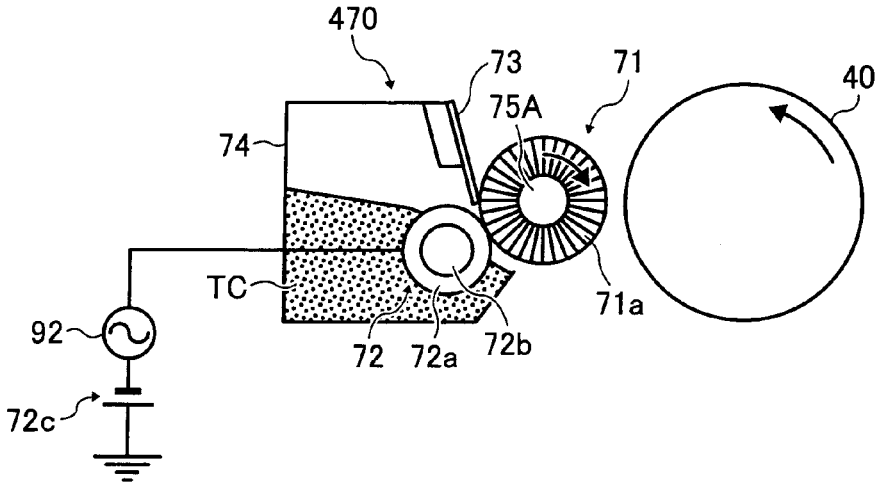
FIG. 11 is a schematic diagram illustrating a development unit according to a third exemplary variation.

Referring now to FIG. 11, there is shown a schematic diagram illustrating a developing unit 470 of the third exemplary variation.

In the third exemplary variation, no electrode plate 91 may be provided. The AC power source 92 may be connected to the rotary sleeve 72*a* of the toner supply roller 72 so as to form the vibration electric field in a space between the toner supply roller 72 and the toner carrying roller 71 without the electrode plate 91. Thereby, the toner adhesion relative to the surface of the toner carrying roller 71 may be reduced.

As a result, in a space between the toner supply roller 72 and the toner carrying roller 71, the adhesion of the toner carried on the toner carrying roller 71 may be reduced relative to the toner carrying roller surface. In the meantime, the toner may be rubbed off or be smoothened by the developer carried on the toner supply roller 72.

In such a manner, as shown in the third exemplary variation, when an AC voltage is applied to a given part disposed facing the surface of the toner carrying roller 71, the separating force or the electrostatic force for parting the toner from the toner carrying roller surface may be applied to the toner.

Consequently, similar to the second exemplary variation, the toner adhesion relative to the surface of the toner carrying roller 71 may be reduced without increasing the number of parts. Thereby, the amount of toner in the flare state may be increased.

As shown in the third exemplary variation, when the AC voltage is applied to the toner supply roller 72, the toner which remains on the surface of the toner carrying roller 71 without contributing to the development process and has passed the developing area may be turned to the flare state. Accordingly, the toner may be rubbed off by the developer on the toner supply roller 72.

Therefore, similar to the first exemplary variation, the toner recovery efficiency by the developer rubbing off the toner may be enhanced. As a result, it is possible to suppress a state in which the toner is firmly adhered to the surface of the toner carrying roller 71 and the reduction of the development efficiency.

Next, a description will be given of an exemplary experiment (hereinafter referred to as a first experiment).

Figure 12:
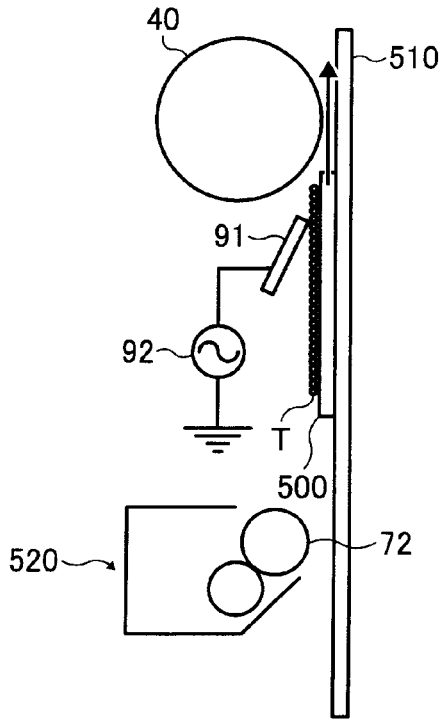
FIG. 12 a schematic diagram illustrating a test equipment used in a first experiment.
Figure 13:
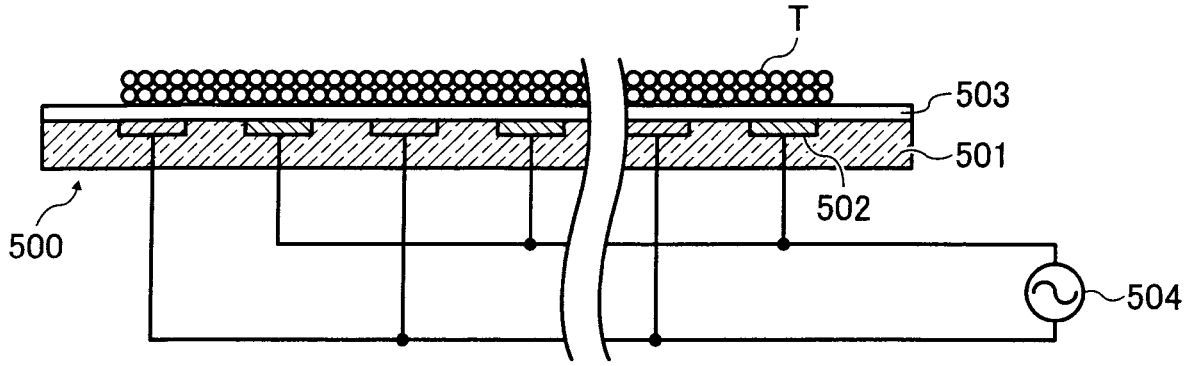
FIG. 13 is a cross-sectional view illustrating a flare development substrate used in the test equipment of FIG. 12.

FIG. 12 a schematic diagram illustrating a structure of a test equipment used in the first experiment. FIG. 13 is a sectional view of a flare development substrate used as a toner carrier in the testing machine taken along the moving direction of the flare development substrate.

In the first experiment, the fluctuation of the flare activity when changing a peak-to-peak voltage (amplitude) Vpp of the AC voltage applied to the electrode 91 were observed.

As shown in FIG. 12, in the test equipment, a flare development substrate 500 was movably structured along a slide rail 510. The flare development substrate 500 could travel back and forth between an opposing region of a toner supply unit 520 and an opposing region or the developing area of the photoreceptor 40.

As shown in FIG. 13, the flare development substrate 500 was structured such that an electrode pattern 502 was formed on a glass substrate 501 by means of aluminum deposition. The electrode pattern 502 was coated with a protective layer 503 which was a resin coating having a thickness of approximately 3 [μm] and a volume resistivity of approximately $10^{10}$[Ω·cm].

The toner supply unit 520 had a similar to, if not the same as, the structure of a common two-component developer. In the toner supply unit 520, the two-component developer was carried by the toner supply roller 72 and was rubbed against the flare development substrate 500.

The developer used in the first experiment contained the magnetic carriers with a particle diameter of approximately 55 [μm] and polyester toner with a particle diameter of approximately 7 [μm] is used. The weight ratio (wt %) of the magnetic carriers and the polyester toner was between 5% and 7%.

The structure of the toner supply roller 72 of the toner supply unit 520 was similar to, if not the same as, the toner supply roller of the first exemplary embodiment. A supply bias was applied to the toner supply roller 72 by the power source (not shown). Thereby, the toner T in the developer on the toner supply roller 72 traveled to the flare developing substrate 500.

In the first experiment, the toner supply roller 72 which was rotatively driven supplied the toner T to the surface of the flare development substrate 500, while moving the flare development substrate 500 to the developing area side along the slide rail 510.

At this time, a power supply 504 shown in FIG. 13 applied an AC voltage to the electrode pattern 502 of the flare development substrate 500. A hopping electric field was formed on the surface of the flare development substrate 500.

When observing the toner on the surface of the flare development substrate 500 immediately after the toner was supplied from the toner supply roller 72, approximately half the amount of the toner was in the flare state. However, the remaining toner was not in the flare state.

Similar to the first exemplary embodiment, the AC voltage applied to the electrode pattern 502 in the first experiment was of the AC voltage with the frequency 1 k[Hz] and the peak-to-peak voltage (amplitude) Vpp of 200[V].

In the test equipment, the electrode plate 91 is disposed immediately before the developing area and is applied the AC voltage by the AC power source 92. Accordingly, the vibration electric field is formed in a space between the electrode plate 91 and the flare development substrate 500.

In the first experiment, the flare activity level was observed when the AC voltage with the frequency of 1 k[Hz] was applied, and the peak-to-peak voltage (amplitude) Vpp thereof was changed.

Figure 14:
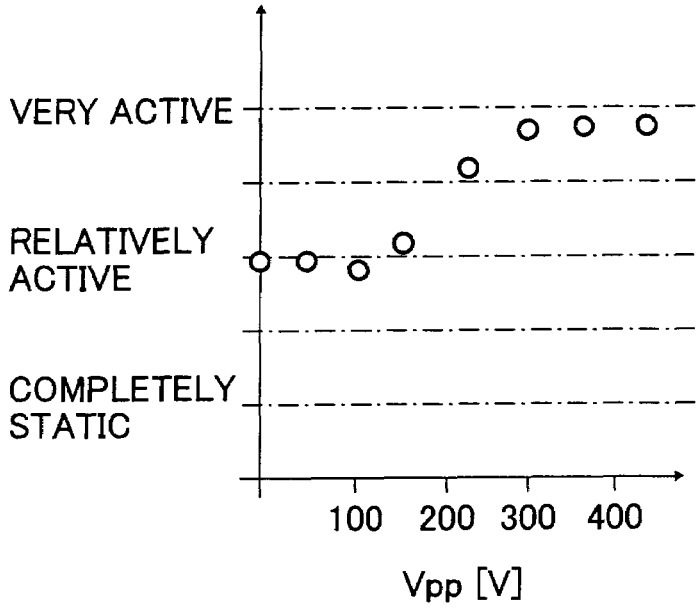
FIG. 14 is a graphical representation illustrating an experiment result of a first experiment.

FIG. 14 is a graphical representation illustrating the result of the first experiment. The peak-to-peak voltage Vpp of the AC voltage applied to the electrode 91 is plotted on the horizontal axis. The flare activity level is plotted on the vertical axis.

The term "flare activity level" herein means a visually evaluated ratio of the static toner to active toner when observing the surface of the flare development substrate 500 by an electron microscope from a normal direction.

The flare activity level when there is no static toner is evaluated as "very active"; whereas, the flare activity level when there is toner of half static and half active is evaluated as "relatively active". The flare activity level when there is no active toner is evaluated as "completely static".

In the first experiment, when applying an AC voltage with a peak-to-peak voltage of approximately no less than 150[V] to the electrode plate 91, the flare activity level of toner was enhanced. A similar effect was also observed when using a wire-type and a roller-type electrode, instead of using a plate-type electrode such as the electrode plate 91.

Therefore, in the first and second exemplary embodiments, as well as each exemplary variation, the similar effect may be achieved when using the wire-type or the roller-type electrode, instead of using a plate-type electrode such as the electrode plate 91. Accordingly, the shape of parts to which the AC voltage for forming the vibration electric field is applied is not limited. Thus, parts allocation may be flexible.

Next, a description will be given of another exemplary experiment (hereinafter referred to as a second experiment.)

In the second experiment, in order to examine the effect of electrical characteristics of the surface of the flare development substrate 500 on the flare activity level, the same test equipment used in the first experiment was used to examine the relationship between the volume resistivity of the protective layer 503 of the flare development substrate 500 and the flare activity level.

In the second experiment, the protective layer 503 of the flare development substrate 500 was of a silicone resin, and the electrode pitch (p) was 50 μm. Furthermore, the flare activity level was observed when changing the amount of carbon fine particles to disperse and using a plurality of flare development substrates 500 equipped with protective layers of a thickness approximately 5 μm, with different volume resistivity ranging from $10^7$ to $10^{14}$ Ω·cm, respectively.

It should be noted that the observation method of the flare activity level was similar to that of the first experiment.

Figure 15:
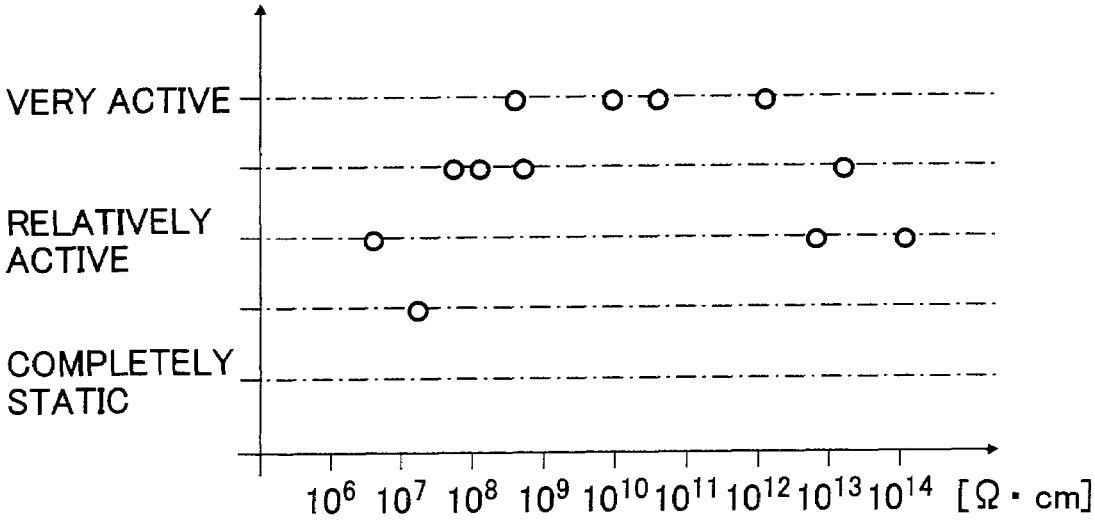
FIG. 15 is a graphical representation illustrating an experiment result of a second experiment.

Referring now to FIG. 15, there is shown a graphical representation which illustrates the experiment result of the second experiment. The volume resistivity Ω·cm is plotted on the horizontal axis. The flare activity level is plotted on the vertical axis.

According to the experiment result, when the volume resistivity of the protective layer 503 of the flare development substrate 500 was in the range between $10^9$ and $10^{12}$[Ω·cm], the flare activity level was favorable.

It may be understood from the experiment result, when the volume resistivity of the protective layer 503 of the flare development substrate 500 is too high, toner may repeatedly hop so that friction may occur between the toner and the protective layer 503.

As a result, the charge may be accumulated in the protective layer 503 causing the protective layer 503 to remain charged.

When the protective layer 503 is charged as described above, the toner may be electrostatically held by the charge of the protective layer 503. Hopping by the hopping electric field may be prevented.

On the other hand, when the volume resistivity of the protective layer 503 of the flare development substrate 500 is too low, an electric leak or short may occur between the electrode patterns 502.

Consequently, an effective bias effect may not be achieved. As a result, an appropriate hopping electric field may not be formed so that toner may not be able to hop.

In light of the above, according to the second experiment result, a protective layer with the volume resistivity between $10^9$ and $10^{12}$ [Ω·cm] may preferably be used for the surface protective layer 71*d* of the toner carrying roller 71.

Next, a description will be given of another experiment result (hereinafter referred to as a third experiment).

In the third experiment, similar to the second experiment, in order to examine the effect of friction charging characteristics of the surface of the flare development substrate 500, the flare activity level of the protective layer 503 formed of a fluoroplastic resin was examined.

According to the experiment result, on the contrary to the protective layer of the silicone resin in which the flare state was maintained for an extended period of time, when using the protective layer 503 of the fluoroplastic resin with the volume resistivity in a range between $10^9$ and $10^{12}$ Ω·cm, the flare state diminished in a short period of time, and the toner became in the static state.

When the amount of charge of the toner on the flare development substrate 500 was measured after the observation, in a case of the protective layer 503 of the silicone resin, the amount of charge of the toner decreased by a small amount when compared with an initial state.

However, in a case of the protective layer 503 of the fluoroplastic resin, the amount of charge of the toner was approximately zero.

When the toner which was not charged was rubbed against the protective layers 503 of both the silicone resin and the fluoroplastic resin, the toner was frictionally charged to a proper polarity in a case of the protective layer 503 of the silicone resin.

On the other hand, in the case of the protective layer 503 of the fluoroplastic resin, the protective layer 503 was scarcely charged. Instead, the protective layer 503 of the fluoroplastic resin was frictionally charged to a reverse polarity by a small amount.

According to the result of the third experiment, when the toner becomes the flare state, the toner and the surface of the flare development substrate 500 collide with one another for a number of times.

For this reason, it may be preferred that the surface material for the flare development substrate 500 be a material which does not eliminate the charge from the toner after the several collisions.

For example, it may be preferred that the material for the surface of the flare development substrate 500 be a material which allows the toner to be charged to any proper polarity after the several collisions.

Therefore, it may be preferred that the protective layer 71*d* of the surface of the toner carrying roller 71 in the first and second exemplary embodiments as well as each exemplary variation be the material described above.

Specifically, the protective layer may preferably be formed of a glass-type or a carrier coat material for the two-component developer.

The copier according to the first and second exemplary embodiments, and the first through third exemplary variations is an image forming apparatus which forms an image on a transfer sheet as a recording material by adhering toner to the latent images on the photoreceptors 40Y, 40M, 40C, 40K and 140 so as to develop the latent images to form toner images. The toner images are then transferred to a transfer sheet as a recording material.

The copier described above is a color image forming apparatus which forms an image by overlaying, on the transfer sheet, a plurality of toner images formed on the photoreceptors 40Y, 40M, 40C, 40K and 140. However, the copier may be a monochrome image forming apparatus.

The developing units 70, 170, 270, 370 and 470 may be equipped with a hopping electric field generator. The hopping electric field generator may apply a periodic voltage to a number of electrodes 81 through 84, and so forth which are disposed along the surface of the toner carrying rollers 71 and 171 serving as a toner carrying member and are insulated from each other.

Accordingly, the hopping electric field generator may generate a hopping electric field for causing the toner charged to a given polarity and carried on the surface of the toner carrying rollers 71 and 171 to hop thereon.

The toner carried on the toner carrying rollers 71 and 171 is transported to the developing area facing the photoreceptors 40Y, 40M, 40C, 40K and 140, and is adhered to the latent images on the photoreceptors 40Y, 40M, 40C, 40K and 140 so that the latent images are developed.

The developing units 70, 170, 270, 370 and 470 may include, separately from the hopping electric field generator, the separating electric field generator serving as a separating force applicator which applies to the toner a separating force for separating the toner from the surface of the toner carrying roller 71 and 171 outside the developing area.

Thereby, even when some kind of external force causes the toner to increase adhesion thereof against the surface of the toner carrying roller, the toner may be separated from the toner carrying roller surface.

As a result, the toner may be able to stably hop in an appropriate hopping electric field generated by the hopping electric field generator. In addition, it may prevent the toner from getting firmly adhered to the surface of the toner carrying roller. Thereby, it may prevent the distortion of the hopping field caused by the firmly adhered toner.

Specifically, in the first and second exemplary embodiments as well as the first through third exemplary variations, the hopping electric field generator applies the periodic voltage to the number of the electrodes 81 through 84 and so forth so as to generate the hopping electric field described above in a manner such that the direction of the electric field between the nearby electrodes may be periodically inverted.

When the surface of the toner carrying rollers 71 and 171 moves, the toner carried thereon is transported to the developing area. In other words, in so far as the toner is able to hop on the toner carrying rollers 71 and 171, the present invention may be applied to a developing method such as an electrostatic transportation method other than the flare development method.

In the flare development method, however, even if the toner is not adequately charged, it is still possible to transport the toner, and thus the ability to transport the toner may be better than the related art electrostatic transportation method in which the toner may not be properly transported unless the toner is adequately charged.

According to the first and second exemplary embodiments as well as the first through third exemplary variations, rollers which are rotatively driven may constitute the toner carrying rollers 71 and 171.

A group of electrodes having an odd number such as the electrode 81 and the electrode 83 constitutes an odd-number electrode group. The first voltage input terminal of the odd-number electrode group is provided to one end of the roller shaft end 75A.

A group of electrodes having an even number such as the electrode 82 and the electrode 84 constitutes an even-number electrode group. The second voltage input terminal of the even-number electrode group is provided to the other shaft end 75B.

When the hopping electric field generator forms a time-periodic potential difference between the group of odd-number electrodes and the group of even-number electrodes, the hopping electric field may be generated.

Thereby, it is possible to form a hopping field which causes the toner to turn to the flare state with a simple structure.

According to the first and second exemplary embodiments as well as the first through third exemplary variations, the separating electric field generator generates the separating electric field for separating the toner from the surface of the toner carrying rollers 71 and 171 by the electrostatic force.

The separating force to separate the toner from the toner carrying roller carried on the surface of the toner carrying rollers 71 and 171 may not be limited to the electrostatic force. It may be a magnetic force or the like.

However, when using the magnetic force as a separating force, for example, the toner needs to be of the magnetic toner.

A drawback of using the magnetic toner may be that the magnetic toner may be more expensive than the non-magnetic toner in terms of its manufacturing cost. The present invention may still be able to separate the non-magnetic toner from the surface of the toner carrying roller.

According to the first and second exemplary embodiments as well as the first through third exemplary variations, the separating electric field generated by the separating electric field generator may be a vibration electric field or an AC electric field.

The separating electric field for separating the toner from the surface of the toner carrying rollers 71 and 171 by the electrostatic force may be a DC electric field. However, the vibration electric field may more effectively separate the toner which strenuously adheres to the surface the toner carrying rollers 71 and 171.

According to the first and second exemplary embodiments, and the second exemplary variation, the separating electric field generator may apply the separating force to the toner carried on the surface of the toner carrying rollers 71 and 171, near the upstream side in the toner conveyance direction relative to the developing area.

Specifically, the developing unit according to the first and second exemplary embodiments, and the second exemplary variation includes the doctor blades 73 and 173 serving as a toner layer thickness regulator for regulating the toner layer carried on the toner carrying rollers 71 and 171 before the toner is transported to the developing area.

The separating electric field generator applies the separating force to the toner after the thickness thereof is regulated by the doctor blades 73 and 173 prior to being transported to the developing area. Thereby, it is possible to transport the toner which has turned to the flare state due to the separating force to the developing area before the external force acts on the toner so that the toner adheres to the surface of the toner carrying roller again.

Accordingly, the toner stably remains in the flare state and is transported to the developing area. Thus, a high development efficiency may be stably achieved.

According to the second exemplary variation, the separating electric field generator applies the separating force to the toner carried on the surface of the toner carrying rollers 71 and 171 using the doctor blades 73 and 173.

Thereby, without increasing the number of parts, the toner adhesion relative to the surface of the toner carrying rollers 71 and 171 may be reduced. Accordingly, it is possible to turn the toner to be transported to the developing area to the flare state.

The developing unit according to the third exemplary variation includes the toner supply rollers 72 and 172 serving as the toner supply member for supplying toner to the surface of the toner carrying rollers 71 and 171.

The separating electric field generator applies the separating force to the toner carried on the surface of the toner carrying rollers 71 and 171 through the toner supply rollers 72 and 172.

Thereby, without increasing the number of parts, the toner adhesion relative to the surface of the toner carrying rollers 71 and 171 may be reduced.

According to the first and second exemplary embodiments as well as the first through third exemplary variations, the surface protective layer 71*d* of the toner carrying rollers 71 and 171 is formed of a silicone resin having the electrical characteristics which may apply a proper charge to the toner by means of friction with the toner.

Thereby, as described in the third experiment, it is possible to stably maintain the toner in the flare state on the surface of the toner carrying rollers 71 and 171 for a long period of time.

According to the first and second exemplary embodiments as well as the first through third exemplary variations, the volume resistivity of the surface protective layer 71*d* of the toner carrying rollers 71 and 171 is in the range between $10^9$ [Ω·cm] and 1012 [Ω·cm].

Thereby, as described in the second experiment, it is possible to stably maintain the toner in the flare state on the surface of the toner carrying rollers 71 and 171.

Furthermore, the periodic voltage to be applied to the number of the electrodes 81 through 84 and so forth may be set in a manner such that the average instantaneous potential of each periodic potential may be the value between the potential of the image portions formed on the photoreceptors 40Y, 40M, 40C, 40K and 140, and the potential of the non-image portion.

The image portions of the surface of the photoreceptors which are evenly charged to a given polarity are exposed so that the potential of the electrostatic latent images is reduced.

In such a case, the voltage applied to the number of electrodes 81 through 84 and so forth may properly form the development electric field which electrostatically adheres the toner charged to the same polarity as the given polarity to the electrostatic latent images.

One or more embodiments of the present invention may be conveniently implemented using a conventional general purpose digital computer programmed according to the teachings of the present specification, as will be apparent to those skilled in the computer art.

Appropriate software coding can readily be prepared by skilled programmers based on the teachings of the present disclosure, as will be apparent to those skilled in the software art.

One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Furthermore, any of the aforementioned methods may be embodied in the form of a program. The program may be stored on a computer readable media and is adapted to perform any one of the aforementioned methods, when run on a computer device (a device including a processor).

Thus, the storage medium or computer readable medium, is adapted to store information and is adapted to interact with a data processing facility or computer device to perform the method of any of the above mentioned embodiments.

The storage medium may be a built-in medium installed inside a computer device main body or a removable medium arranged so that it can be separated from the computer device main body.

Examples of a built-in medium include, but are not limited to, rewriteable non-volatile memories, such as ROMs and flash memories, and hard disks. Examples of a removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

Obviously, numerous modifications and variations of the present invention are possible in light of the above teachings. It is therefore to be understood that within the scope of the appended claims, the invention may be practiced otherwise than as specifically described herein.

The invention claimed is:

1. A developing unit for transferring toner onto a latent image on an image carrier, comprising:

a toner carrier configured to bear and transport the toner to a developing area facing the image carrier, and including a plurality of electrodes disposed along a surface thereof and insulated from each other;

an electric field generator configured to apply a periodic voltage to the plurality of electrodes of the toner carrier to generate an electric field on the toner carrier surface;

a separating force applicator configured to apply a separating force to separate the toner on the toner carrier from the surface thereof outside the developing area, wherein the separating force applicator is disposed separately from the electric field generator; and a layer thickness regulator configured to regulate a thickness of the toner on the toner carrier surface before the toner is transported to the developing area, wherein the separating force applicator applies the separating force to the toner on the toner carrier surface through the layer thickness regulator.

2. The developing unit according to claim 1, wherein:

the electric field generator is configured to periodically invert the direction of the electric field between the electrodes adjacent to each other; and the toner carrier is configured to rotate to transport the toner to the developing area.

3. The developing unit according to claim 2, wherein the toner carrier further comprises:

a roller configured to rotatively move, the roller comprising a roller shaft with one end including a first voltage input terminal to input a voltage to an odd-numbered group of electrodes, and the other end including a second voltage input terminal to input a second voltage to an even-numbered group of electrodes, wherein the electric field generator forms a time-periodic potential difference between the odd-numbered group of electrodes and the even-numbered group of electrodes.

4. The developing unit according to claim 1, wherein:

the toner carrier further comprises a surface layer formed of a material capable of frictionally applying a regular charge to the toner.

5. The developing unit according to claim 1, wherein:

the surface layer has a volume resistivity in a range between $10^9$ and $10^{12}$ Ω·cm.

6. The developing unit according to claim 1, wherein:

the periodic voltage applied to the plurality of electrodes is controlled such that an average potential of the periodic potential is between the potentials of an image area formed on the image carrier and a non-image area.

7. An image forming apparatus, comprising:

an image carrier;

a charging device configured to charge the image carrier;

an exposure unit configured to irradiate the image carrier to form a latent image thereon;

a developing unit configured to develop the latent image with toner to form a toner image on the image carrier; and a transfer unit configured to transfer the toner image onto a recording material, wherein the developing unit is the developing unit of claim 1.

8. The image forming apparatus according to claim 7, further comprising:

a plurality of image carriers, wherein each of the toner images is overlaid on one another on the recording material.

9. A developing unit for transferring toner onto a latent image on an image carrier, comprising:

a toner carrier configured to bear and transport the toner to a developing area facing the image carrier, and including a plurality of electrodes disposed along a surface thereof and insulated from each other;

an electric field generator configured to apply a periodic voltage to the plurality of electrodes of the toner carrier to generate an electric field on the toner carrier surface;

a separating force applicator configured to apply a separating force to separate the toner on the toner carrier from the surface thereof outside the developing area, wherein the separating force applicator is disposed separately from the electric field generator; and a toner feeder configured to supply the toner onto the surface of the toner carrier, wherein the separating force applicator applies the separating force to the toner on the toner carrier surface through the toner feeder.

10. The developing unit according to claim 9, wherein:

the electric field generator is configured to periodically invert the direction of the electric field between the electrodes adjacent to each other; and the toner carrier is configured to rotate to transport the toner to the developing area.

11. The developing unit according to claim 10, wherein the toner carrier further comprises:

a roller configured to rotatively move, the roller comprising a roller shaft with one end including a first voltage input terminal to input a voltage to an odd-numbered group of electrodes, and the other end including a second voltage input terminal to input a second voltage to an even-numbered group of electrodes, wherein the electric field generator forms a time-periodic potential difference between the odd-numbered group of electrodes and the even-numbered group of electrodes.

12. The developing unit according to claim 9, wherein:

the toner carrier further comprises a surface layer formed of a material capable of frictionally applying a regular charge to the toner.

13. The developing unit according to claim 12, wherein:

the surface layer has a volume resistivity in a range between $10^9$ and $10^{12}$ Ω·cm.

14. The developing unit according to claim 9, wherein:

the periodic voltage applied to the plurality of electrodes is controlled such that an average potential of the periodic potential is between the potentials of an image area formed on the image carrier and a non-image area.

15. An image forming apparatus, comprising:

an image carrier;

a charging device configured to charge the image carrier;

an exposure unit configured to irradiate the image carrier to form a latent image thereon;

a developing unit configured to develop the latent image with toner to form a toner image on the image carrier; and a transfer unit configured to transfer the toner image onto a recording material, wherein the developing unit is the developing unit of claim 9.

16. The image forming apparatus according to claim 15, further comprising:

a plurality of image carriers, wherein each of the toner images is overlaid on one another on the recording material.

* * * * *